US010151133B2

(12) United States Patent
Dieners et al.

(10) Patent No.: US 10,151,133 B2
(45) Date of Patent: Dec. 11, 2018

(54) SLIDING-DOOR ASSEMBLY

(71) Applicant: GRETSCH-UNITAS GMBH BAUBESCHLAEGE, Ditzingen (DE)

(72) Inventors: Udo Dieners, Grossbottwar (DE); Jens Johann Grosse, Schwieberdingen (DE)

(73) Assignee: GRETSCH-UNITAS GMBH BAUBESCHLAEGE, Ditzingen (DE)

( * ) Notice: Subject to any disclaimer, the term of this patent is extended or adjusted under 35 U.S.C. 154(b) by 0 days.

(21) Appl. No.: 15/126,590

(22) PCT Filed: Mar. 13, 2015

(86) PCT No.: PCT/EP2015/055311
§ 371 (c)(1),
(2) Date: Sep. 16, 2016

(87) PCT Pub. No.: WO2015/140068
PCT Pub. Date: Sep. 24, 2015

(65) Prior Publication Data

US 2017/0081896 A1 Mar. 23, 2017

(30) Foreign Application Priority Data

Mar. 17, 2014 (EP) ..... 14160171

(51) Int. Cl.
*E05F 15/635* (2015.01)
*E05F 15/643* (2015.01)

(52) U.S. Cl.
CPC ..... *E05F 15/635* (2015.01); *E05F 15/643* (2015.01); *E05Y 2201/652* (2013.01); *E05Y 2201/668* (2013.01); *E05Y 2900/132* (2013.01)

(58) Field of Classification Search
CPC ..... E05F 15/635; E05F 15/643
See application file for complete search history.

(56) References Cited

U.S. PATENT DOCUMENTS 1,594,513 A * 8/1926 Ainsworth ..... E05F 15/643 109/3
3,775,906 A * 12/1973 Dougherty ..... E05F 15/635 49/358
4,887,205 A * 12/1989 Chou ..... H02H 7/0851 49/25
5,230,179 A * 7/1993 Richmond ..... E05F 15/643 49/28

(Continued)

FOREIGN PATENT DOCUMENTS

DE 4015448 A1 * 11/1991 ..... F16G 1/00
DE 10248608 A1 4/2004

(Continued)

*Primary Examiner* — Marcus Menezes
(74) *Attorney, Agent, or Firm* — Leydig, Voit & Mayer, Ltd.

(57) ABSTRACT

The invention relates to a sliding-door assembly, including a stationary frame, a horizontally movable door leaf, and a drive device for moving the door leaf, which drive device includes a drive motor, which is arranged on the leaf and has a toothed wheel, which interacts with a toothed belt arranged on the frame, wherein the toothed belt is wrapped around the toothed wheel over a partial periphery of the toothed wheel and wherein at least two teeth of the toothed wheel are simultaneously fully engaged with at least two teeth of the toothed belt.

11 Claims, 3 Drawing Sheets

(56) References Cited

U.S. PATENT DOCUMENTS

| | | | | | |
|---|---|---|---|---|---|
| 6,025,685 | A * | 2/2000 | Parsadayan | E05F 15/63 | 318/266 |
| 6,108,977 | A * | 8/2000 | Payne | E05F 15/603 | 192/99 S |
| 6,233,878 | B1 | 5/2001 | Kraehenbuehl et al. | | |
| 6,481,160 | B1 * | 11/2002 | Kowalczyk | E05F 3/224 | 49/333 |
| 8,707,627 | B2 * | 4/2014 | Murray | E05F 15/79 | 49/324 |
| 2003/0034750 | A1 * | 2/2003 | Hom | E05F 15/603 | 318/445 |

FOREIGN PATENT DOCUMENTS

| | | | | | |
|---|---|---|---|---|---|
| DE | 102004023133 | A1 * | 12/2005 | E05F 15/643 | |
| EP | 0881409 | A1 * | 12/1998 | F16C 33/306 | |
| EP | 0953706 | B2 | 11/1999 | | |
| EP | 1479863 | A2 | 11/2004 | | |
| EP | 2063058 | A2 | 5/2009 | | |
| WO | WO 2008015300 | A1 | 2/2008 | | |
| WO | WO-2012147226 | A1 * | 11/2012 | B61B 1/02 | |

* cited by examiner

SLIDING-DOOR ASSEMBLY

CROSS-REFERENCE TO RELATED APPLICATIONS

This application is a U.S. National Phase application under 35 U.S.C. § 371 of International Application No. PCT/EP2015/055311, filed on Mar. 13, 2015, and claims benefit to European Patent Application No. 14160171.6, filed on Mar. 17, 2014. The International Application was published in German on Sep. 24, 2015 as WO 2015/140068 A1 under PCT Article 21(2).

FIELD

The invention relates to a sliding door assembly, in particular a lift and slide door assembly, including a fixed frame, a horizontally displaceable door leaf and a drive device for displacing the door leaf which includes a drive motor, arranged on the leaf, having a gear wheel which cooperates with a toothed belt arranged on the frame.

BACKGROUND

A sliding door assembly for a stackable sliding wall is known from EP 0 953 706 B2. With sliding door assemblies or with lift and slide door assemblies which are used as part of the glazing of a building, there is the problem that in particular door leaves having multiple glazing can be very heavy, and may weigh for example 200 kilograms or more. If such a door leaf is to be displaceable not manually, but driven by a motor, the drive motor has to provide a correspondingly high motive force. At the same time, however, for visual reasons the drive motor should only take up as little installation space as possible.

SUMMARY

Proceeding therefrom, it is the object of the present invention to improve a sliding door assembly of the type referred to at the outset such that the drive device is also suitable for heavy door leaves and can be integrated in the door leaf as visually unobtrusively as possible.

This object is achieved according to the invention in that the toothed belt wraps around the gear wheel over a partial circumference of the gear wheel, and in that at least two teeth of the gear wheel are simultaneously fully engaged with at least two teeth of the toothed belt.

According to the invention, a motive force of the drive motor is transmitted to a toothed belt by way of a gear wheel, at least two teeth of the gear wheel and at least two teeth of the toothed belt simultaneously being fully engaged with one other. The drive device according to the invention makes it possible to even out the transmission of force from the drive motor to the toothed belt. This evening-out thus involves the possibility of avoiding torque peaks of the drive motor. This allows the use of drive motors which are not designed for a high peak power and which therefore can be of comparatively small and slim construction. In this manner, it is possible to integrate the drive motor in the door leaf in a visually appealing manner, yet in which it is simultaneously able to displace even very heavy door leaves if required.

It is preferable if the partial circumference is at least 45°, preferably at least 90°, in particular at least 120°. In this manner, not only at least two pairs of teeth, but preferably at least three pairs of teeth, in particular at least four pairs of teeth, can be fully engaged with each other simultaneously if required.

Preferably at least a first deflecting element is provided which cooperates with a rear side of the toothed belt. Such a deflecting element enlarges the partial circumference over which the toothed belt wraps around the gear wheel.

It is particularly preferable if a second deflecting element is provided that cooperates with the rear side of the toothed belt. This makes possible further enlargement of the partial circumference with which the toothed belt wraps around the gear wheel.

When using two deflecting elements, it is preferable, viewed in the running direction of the toothed belt, if a first deflecting element is arranged on the input side of the gear wheel and the second deflecting element on the output side of the gear wheel.

It is possible for the deflecting element or the deflecting elements to have sliding faces along which the rear side of the toothed belt slides. However, it is preferable for the deflecting element to be formed as a deflecting roll, or for the deflecting elements to be formed as deflecting rolls. This allows particularly low-friction rolling contact between the rear side of the toothed belt and a deflecting face of the deflecting rolls.

It is preferable if the deflecting rolls and the gear wheel have axes of rotation which are parallel to one other, so that the toothed belt is not twisted, viewed in the running direction of the toothed belt.

In a preferred embodiment, the axes of rotation of the deflecting rolls and of the gear wheel are arranged within one plane. This makes a particularly compact arrangement of deflecting rolls and gear wheel possible.

It is possible to use a continuous toothed belt. However, it is preferable if a toothed belt which is open at the end and the ends of which are fixed to the frame is used. This facilitates particularly unobtrusive and space-saving integration of the toothed belt on the fixed frame.

The integration of the toothed belt is further facilitated if it is arranged on a horizontal frame part, at the top when in the installation position, of the fixed frame.

A drive motor of particularly small construction can be used if the drive device includes a reduction gear for reducing a drive speed of the drive motor. In this case, this is preferably a planetary gear which is of particularly compact construction, in particular a two-stage planetary gear. Using a two-stage planetary gear has the advantage that the self-locking of the reduction gear is not so great that manual displacement of the door leaf would no longer be possible.

However, it is also possible to use a direct drive (i.e. without a reduction gear), or an only single-stage reduction gear, in order to further reduce the self-locking of the drive.

It is further preferable if a drive axis of the drive motor is oriented in the vertical direction. In this manner, when using a toothed belt running in the horizontal direction it is possible to dispense with a deflection gear, for example an angular gear.

In order to integrate the drive motor in the door leaf, it is proposed that the drive motor be arranged in a vertical profile section of the door leaf, in particular in a vertical profile section remote from a handle side of the door leaf. This has the advantage that when the door leaf is upright, the drive motor can be mounted in a simple manner and can be accessed rapidly if required.

It is particularly preferable if at least one battery arranged on the leaf is provided to supply power to the drive motor. Such a battery has the advantage that it is, in principle, not necessary to also have suitable, but space-consuming, power supply equipment, for example trailing cables or conductor bars with sliding contacts.

The at least one battery is preferably likewise arranged in a vertical profile section of the door leaf, in particular in a vertical profile section remote from a handle side of the door leaf. This makes simple mounting of the at least one battery on an upright door leaf possible. In addition, the replacement of a battery which may possibly be necessary after a relatively long period of use is thus possible without problems.

Finally, it is preferable if a controller for controlling the drive motor is provided which is preferably arranged in a vertical profile section of the door leaf, in particular in a vertical profile section remote from a handle side of the door leaf. Not only does this result in a particularly visually appealing design but also in particularly good accessibility of all the components of the drive device which are arranged on the leaf, in particular in combination with integration of the drive motor and at least one battery in the same vertical profile section of the door leaf.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
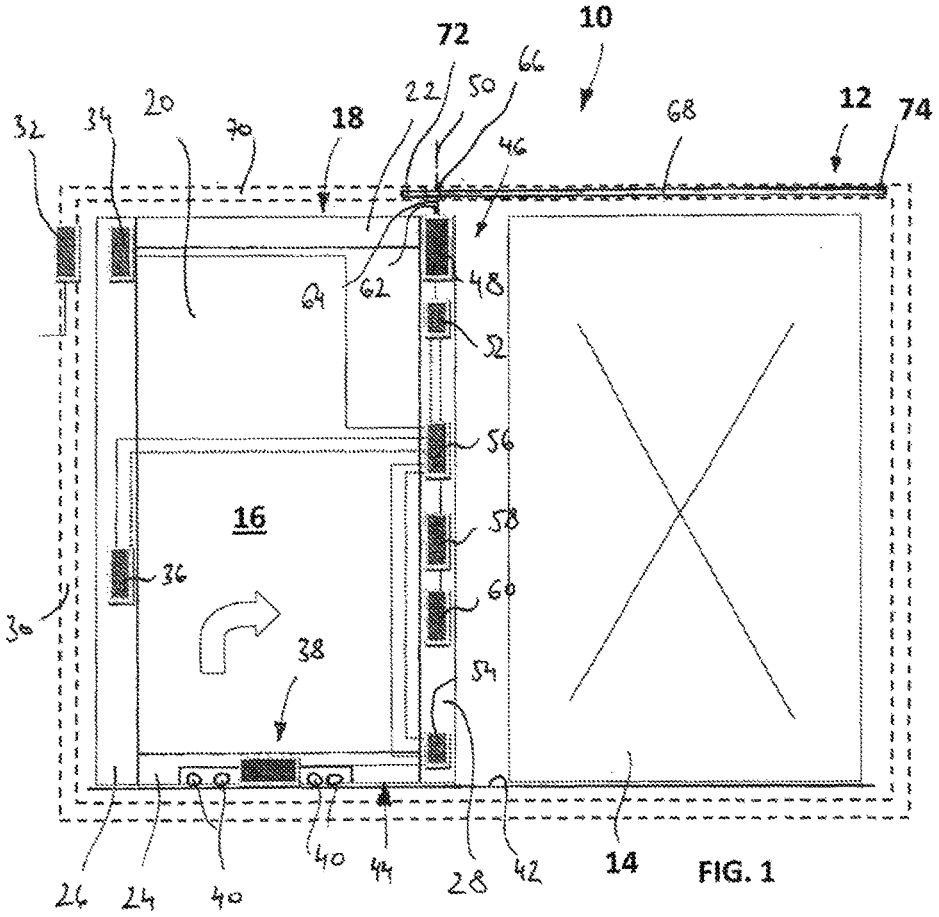
FIG. 1 is a schematic view of an embodiment of a sliding door assembly having a drive device configured to displace a door leaf.

An embodiment of a sliding door assembly is schematically illustrated in FIG. 1 and is denoted by the reference numeral 10. The assembly 10 includes a frame, represented by broken lines, which is fixed and is attached to the building. The frame 12 preferably has an in particular glazed fixed panel 14 which is marked with a diagonal cross in the drawing.

The frame 12 also serves for arranging a door leaf 16, which can be displaced between a closed position illustrated in FIG. 1 and an opened position in which the door leaf 16 overlaps the fixed panel 14 at least in portions.

The door leaf 16 is in particular a lift and slide door, which is therefore not only horizontally displaceable, but can also be raised and lowered. In a lowered state of the door leaf, effective sealing of the door leaf 16 on the frame 12 is facilitated. In a raised state of the door leaf 16, it can be displaced horizontally.

The door leaf 16 has a sash frame 18 which delimits a sash panel 20. The sash panel 20 may be formed for example by glazing. The sash frame 18 has an upper profile section 22, a lower profile section 24 and also vertical profile sections 26 and 28.

When the door leaf 16 is closed, the vertical profile section 26 is in contact with a vertical frame part 30 of the frame 12. In the context of the present invention, this vertical profile section is understood to be the "handle-side" profile section. When the door leaf 16 is closed, it is possible for the vertical profile section 26 and the vertical frame part 30 of the frame 12 to be bolted together.

In the event that the door leaf 16 is to be raised by manual force, the first vertical profile section 26 serves for arranging a lift and turn handle (not shown).

The first vertical profile section 26 and the vertical frame part 30 also serve for arranging electrical contacts 32 and 34, which, when the door leaf 16 is closed, are in contact with each other in order to supply power from the building. The electrical contacts 32 and 34 may touch each other, or alternatively may be designed inductively in order to achieve a contactless power supply.

In a preferred embodiment, the first vertical profile section 26 serves for arranging an operating unit 36, which is built into the door leaf 16 in particular instead of a handle.

In a preferred embodiment, the door leaf 16 can be raised by way of a motor-driven lifting device 38. When the door leaf 16 is raised, rollers 40 arranged in the leaf are in contact with a runner rail 42 arranged on the frame. When the door leaf 16 is lowered, the door leaf 16 lies with an underside 44 on the runner rail 42.

The second vertical profile section 28 serves for arranging components of a drive device 46, described below, for displacing the door leaf 16 in the horizontal direction.

A drive motor 48, the drive axis 50 of which is oriented in the vertical direction, is arranged in an upper region of the second vertical profile section 28. The drive motor 48 cooperates with an output stage 52 which is preferably arranged beneath the drive motor 48 in the second vertical profile section 28.

An output stage 54 which cooperates with the motor-driven lifting device 38 is preferably arranged on a lower end of the second vertical profile section 28.

Furthermore, the second vertical profile section 28 serves for arranging a controller 56 and also at least one battery 58, 60.

In the schematic view of FIG. 1, lines between the described components of the sliding door assembly 10 are illustrated with unbroken or dotted lines. In this case, the unbroken lines represent current-conducting lines, while the dotted lines represent data lines. The lines mentioned likewise run within the profile sections 22, 24, 26, and 28 of the door leaf 16; however, in order to improve clarity, in FIG. 1 the lines are illustrated as if they run through the panel 20.

Figure 2:
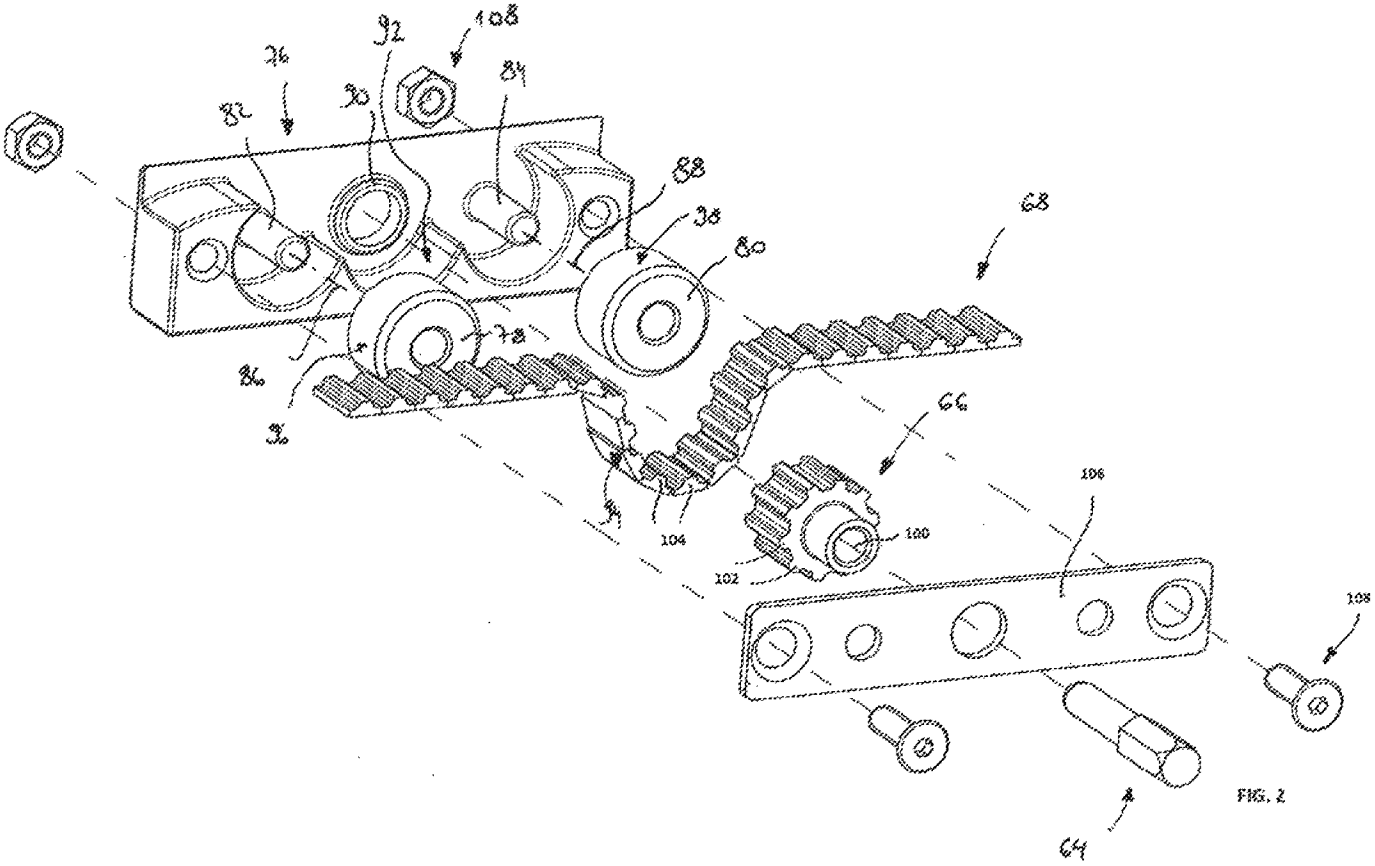
FIG. 2 is an exploded view of part of the drive device according to FIG. 1.

The drive motor 48 has an output shaft 62 which cooperates in positive manner with a shaft 64 illustrated in FIG. 2. The shaft 64 is connected for conjoint rotation with a gear wheel 66. The gear wheel 66 meshes with a toothed belt 68 which is arranged within an upper, horizontal frame part 70 of the frame 12.

The toothed belt 68 is open at the end and is fastened by its ends 72 and 74 to the frame part 70 of the frame 12.

Figure 3:
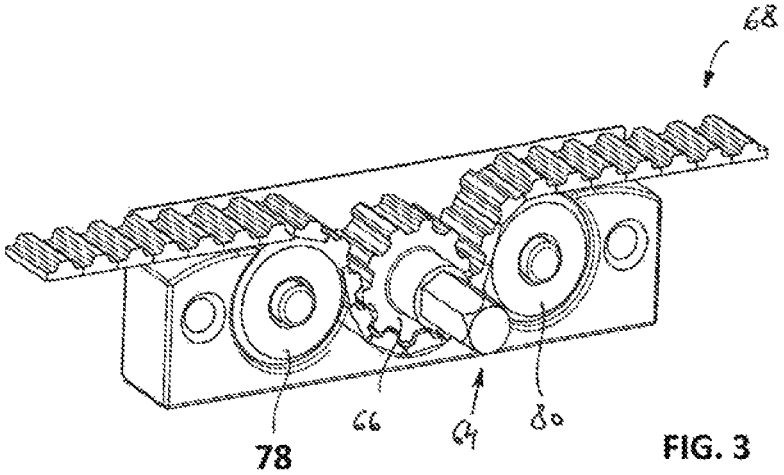
FIG. 3 is a perspective view of the part of the drive device according to FIG. 2.
Figure 4:
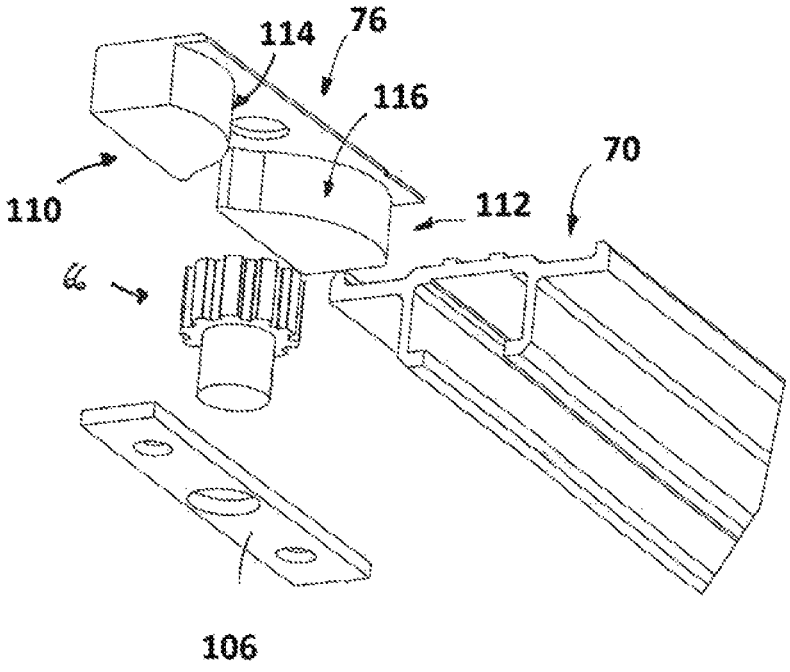
FIG. 4 is an exploded view of a further embodiment of a part of a drive device.

Upon displacement of the door leaf 16, the door leaf 16, together with the above-described components of the drive device 46 and together with the components illustrated in FIGS. 2 and 3, moves along the fixed toothed belt 68. In this case, the components illustrated in FIGS. 2 and 3 slide within a sliding guide, which is open at the bottom and is formed on the frame part 70.

The unit of FIGS. 2 and 3 includes a support 76 on which two deflecting elements in the form of deflecting rolls 78, 80 are mounted. Bearing pins 82, 84 which are fixed to the support are provided for mounting the deflecting rolls 78, 80, which bearing pins define axes of rotation 86, 88 of the deflecting rolls 78, 80.

The support 76 preferably also serves for guiding a side of the gear wheel 66 which is remote from the drive motor 48. For example, an annular guide face 90 can be provided for this.

The support 76 also serves for arranging a curved guide face 92 which is in the form of part of a circle and cooperates with a rear side 94 of the toothed belt 68. The rear side 94 of the toothed belt 68 furthermore cooperates with the running faces 96, 98 of the deflecting rolls 78, 80 which point radially outwards.

The axes of rotation 86, 88 of the deflecting rolls 78, 80 extend in parallel with one another and are arranged within one plane. An axis of rotation 100 of the gear wheel 66 extends preferably likewise within the plane or is spaced apart only slightly, for example by at most 20 mm, from the plane.

A minimum spacing provided between the deflecting faces 96, 98 is only slightly greater (for example by at most 20 mm) than a diameter of the gear wheel 66 measured on the outside of the teeth. In this manner, the toothed belt 68 can be guided such that it wraps around the gear wheel 66 over a partial circumference of at least approximately 120°. In this manner, at least two, in particular at least four, teeth 102 of the gear wheel 66 are simultaneously fully engaged with respective teeth 104 of the toothed belt 68.

It is preferable for the deflecting rolls 78 and 80 and of the gear wheel 66 to be secured on the support 76, in particular using a plate 106, illustrated merely in FIG. 2, which can be screwed to the support 76 by way of a screw 108.

For particularly low-friction running of the door of the door leaf 16, it is preferable to use deflecting rolls 78, 80. In a simplified and particularly inexpensive embodiment, provision is made for the deflecting elements 110, 112 to have immobile deflecting faces 114, 116. The rear side 94 of the toothed belt 78 slides on these deflecting faces. Moreover, the functions of the components illustrated in FIGS. 2 and 3 and also in the figure correspond to each other.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A sliding door assembly, comprising:

a fixed frame;

a horizontally displaceable door leaf;

a first deflecting element formed as a first deflecting roll;

a second deflecting element formed as a second deflecting roll; and a drive device for displacing the door leaf, wherein the drive device comprises a drive motor, arranged on the door leaf, having a gear wheel which cooperates with a toothed belt arranged on the fixed frame, wherein the toothed belt wraps around the gear wheel over a partial circumference of the gear wheel, wherein at least two teeth of the gear wheel are simultaneously fully engaged with at least two teeth of the toothed belt, wherein the first deflecting element and the second deflecting element cooperate with a rear side of the toothed belt, wherein the first deflecting element, the second deflecting element, and the gear wheel are arranged on a support, wherein the toothed belt is arranged on a horizontal frame part, at a top portion when in an installation position, of the fixed frame, wherein a drive axis of the drive motor is oriented in a vertical direction, wherein an axis of rotation of each of the first deflecting roll, the second deflecting roll and the gear wheel are parallel to each other, wherein either the axis of rotation of each of the first deflecting roll, the second deflecting roll, and the gear wheel are arranged within one plane, or the axis of rotation of each of the first deflecting roll and the second deflecting roll are arranged within a first plane and the axis of rotation of the gear wheel is spaced apart by at most 20 mm from the first plane, wherein the one plane and the first plane are parallel to the axis of rotation of each of the first deflecting roll and the second deflecting roll, and wherein the horizontal frame part is formed as a sliding guide, the sliding guide being substantially U-shaped and open at a bottom of the sliding guide and in which the first deflecting roll, the second deflecting roll, and the gear wheel are slidably arranged therein.

2. The sliding door assembly according to claim 1, wherein the partial circumference amounts to at least 45°.

3. The sliding door assembly according to claim 1, wherein the first deflecting element, viewed in a running direction of the toothed belt, is arranged on an input side of the gear wheel and the second deflecting element, viewed in the running direction of the toothed belt, is arranged on an output side of the gear wheel.

4. The sliding door assembly according to claim 1, wherein the toothed belt includes open ends and the ends of the toothed belt are fixed to the frame.

5. The sliding door assembly according to claim 1, wherein the drive device comprises a reduction gear for reducing a drive speed of the drive motor.

6. The sliding door assembly according to claim 1, wherein the drive motor is arranged in a vertical profile section of the door leaf, wherein the vertical profile section is remote from a handle side of the door leaf.

7. The sliding door assembly according to claim 1, further comprising:

at least one battery arranged on the leaf configured to supply power to the drive motor.

8. The sliding door assembly according to claim 7, wherein the battery is arranged in a vertical profile section of the door leaf, wherein the vertical profile section is remote from a handle side of the door leaf.

9. The sliding door assembly according to claim 1, further comprising:

a controller configured to control the drive motor arranged in a vertical profile section of the door leaf, wherein the vertical profile section is remote from a handle side of the door leaf.

10. The sliding door assembly according to claim 1, wherein the partial circumference amounts to at least 90°.

11. The sliding door assembly according to claim 1, wherein the partial circumference amounts to at least 120°.

* * * * *